United States Patent [19]

Rinker

[11] Patent Number: 4,469,331

[45] Date of Patent: Sep. 4, 1984

[54] THREE DIMENSIONAL JIGSAW PUZZLE

[76] Inventor: James K. Rinker, 618 N. Orange Dr., Los Angeles, Calif. 90036

[21] Appl. No.: 426,870

[22] Filed: Sep. 29, 1982

[51] Int. Cl.[3] ..... A63F 9/12
[52] U.S. Cl. ..... 273/157 R
[58] Field of Search ..... 273/157 R

[56] References Cited

U.S. PATENT DOCUMENTS 1,964,007 6/1934 Parks ..... 273/157 R
3,682,479 8/1972 Miller et al. ..... 273/157 R

FOREIGN PATENT DOCUMENTS 419311 11/1934 United Kingdom ..... 273/157 R

*Primary Examiner*—Anton O. Oechsle
*Attorney, Agent, or Firm*—Blakely, Sokoloff, Taylor & Zafman

[57] ABSTRACT

A three dimensional jigsaw comprised of a plurality of single-layered and multi-layered interlocking puzzle pieces which combine to form, when the puzzle is assembled, a plurality of superimposed, concentric planer layers of differing surface area is disclosed. When the puzzle is properly assembled, a continuous homogenous pictoral illustration is displayed on the surface of each visable planar layer of the puzzle.

3 Claims, 6 Drawing Figures

Fig. 1
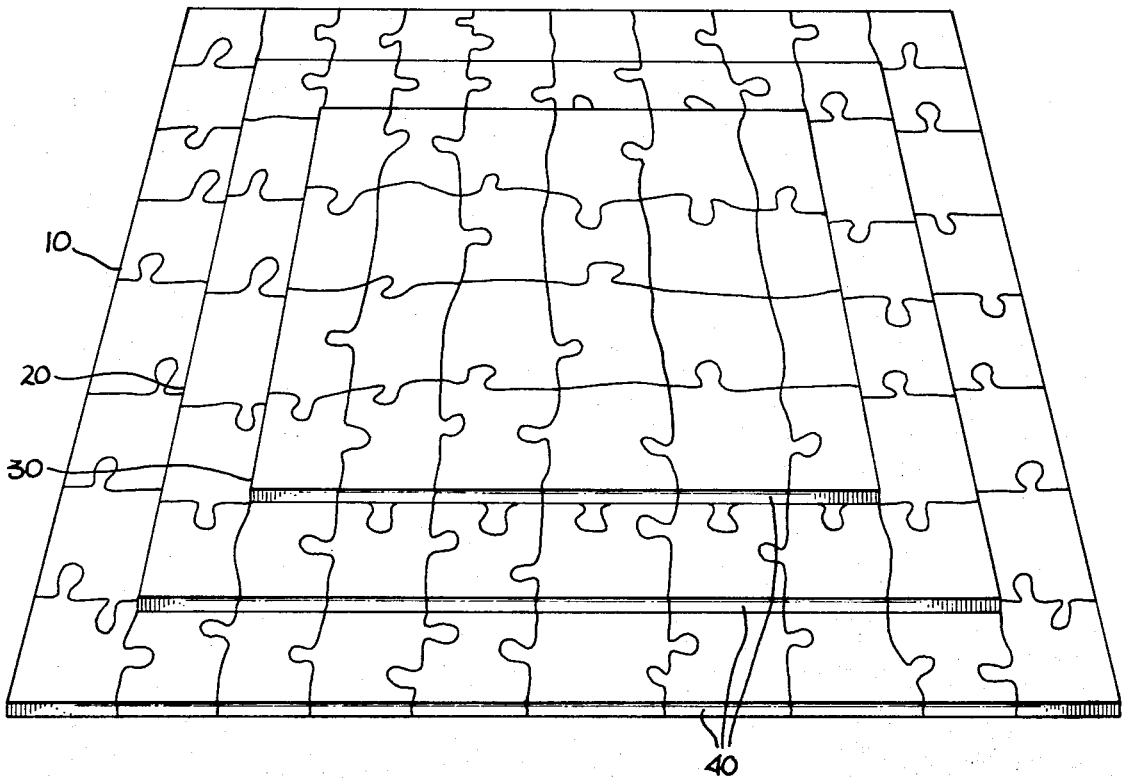
Fig. 2
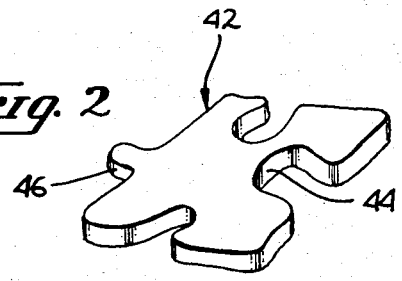
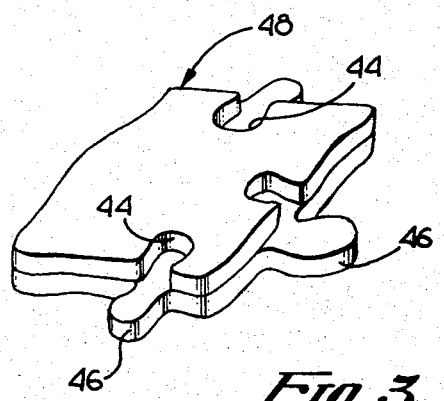
Fig. 3
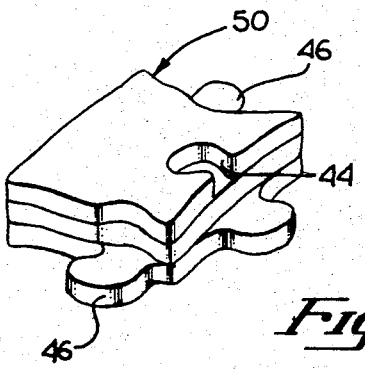
Fig. 4

THREE DIMENSIONAL JIGSAW PUZZLE

BACKGROUND OF THE INVENTION

1. Field of the Invention

The present invention relates to jigsaw puzzles having a plurality of interlocking puzzle pieces which combine to form a planar layer and display a pictorial illustration on the surface of the puzzle, and more specifically, to a jigsaw puzzle which forms a three dimensional object by matching a plurality of single and multi-layered interlocking puzzle pieces to form a plurality of superimposed, concentric planar layers of differing surface area which display a pictorial illustration on the surface of each visible planar layer of the puzzle.

2. Art Background

Jigsaw puzzles which are assembled by matching a number of interlocking puzzle pieces to form a two dimensional pictorial illustration on the surface of the puzzle are well-known. These two dimensional jigsaw puzzles are typically comprised of interlocking puzzle pieces which are one layer thick and form a single planar layer when the puzzle is assembled. The principal way to increase the difficulty of assembling two dimensional puzzles is by increasing the number of interlocking puzzle pieces. While increasing the difficulty in this manner may present a greater challenge to puzzle assemblers, as a practical matter, it merely increases the amount of time necessary to complete the puzzle and does not present new or imaginative methods in the way the puzzle is assembled; the basic technique of assembly is still the same. As a result, three dimensional puzzles were created to provide a greater challenge over common two dimensional puzzles.

One type of three dimensional puzzle is disclosed in Miller et al, U.S. Pat. No. 3,682,479, wherein interlocking puzzle pieces are matched to form distinct planar layers which are stacked upon each other. Each separate layer contains voids through which portions of the layers beneath it may be visible. A second type of three dimensional puzzle is shown in Parks, U.S. Pat. No. 1,964,007, wherein interlocking puzzle pieces are matched as in Miller et al to separately form distinct planar layers which are stacked upon each other. The stacked layers produce a variety of geometric objects displaying pictorial illustrations on all surfaces of the object. While the approach of Miller et al and Parks produces three dimensional objects which may be visually more pleasing, neither presents a greater challenge to the puzzle assembler other than requiring the assembler to determine which layer a particular interlocking puzzle piece belongs. It is then only a matter of stacking one completed layer upon the other to produce a three dimensional object. In essence, these prior art configurations effectively are like completing a number of separate puzzles, each puzzle forming a separate planar layer which is stacked upon other planar layers, to form the three dimensional object.

A third type of three dimensional puzzle is disclosed in Launzel, U.S. Pat No. 4,257,606, wherein interlocking puzzle pieces having flat bases and contoured surfaces are matched to form a sculptured or three dimensional object on a single layer. Although the surface of the resulting object has a contoured, three dimensional character, the puzzle is assembled in the same manner as that of a two dimensional puzzle.

It is therefore desirable to obtain a three dimensional jigsaw puzzle that provides a more challenging and innovative means of assembly than the two and three dimensional puzzles presently available.

SUMMARY OF THE INVENTION

A three dimensional jigsaw puzzle formed from single and multi-layered interlocking puzzle pieces is disclosed. The single-layered interlocking puzzle pieces consist of individual puzzle pieces that are one layer thick. The multi-layered interlocking puzzle pieces consist of two or more single-layered puzzle pieces that are attached to each other at adjacent levels of the puzzle (i.e., the topmost surface of one piece is attached to the bottom-most surface of another piece at corresponding positions in relationship to the puzzle when completed). The multi-layered pieces interlock with adjacent pieces on corresponding levels of the puzzle.

One object of the invention is to provide a novel means of matching a number of interlocking puzzle pieces to form a three dimensional object.

Another object of the invention is to provide a means of assembling a three dimensional puzzle which presents a greater challenge to experienced puzzle assemblers by requiring them to work on all levels of the puzzle simultaneously.

Still another object of the invention is to provide a three dimensional puzzle which, when properly assembled, displays a continuous and homogeneous pictorial illustration on the surface of each visible planar layer of the puzzle.

The foregoing objects and other objects and advantages of the invention will hereinafter appear upon a reading of the detailed description of the invention and appended claims.

BRIEF DESCRIPTION OF THE DRAWINGS

FIG. 1 is a perspective view of the puzzle embodying the invention, showing the puzzle in an assembled state.

FIG. 2 is a perspective view showing a single layered interlocking puzzle piece consisting of one layer.

FIG. 3 is a perspective view showing a multi-layered interlocking puzzle piece consisting of two single-layered puzzle pieces.

FIG. 4 is a perspective view showing a multi-layered interlocking puzzle piece consisting of three single-layered puzzle pieces.

DETAILED DESCRIPTION OF THE INVENTION

Figure 5:
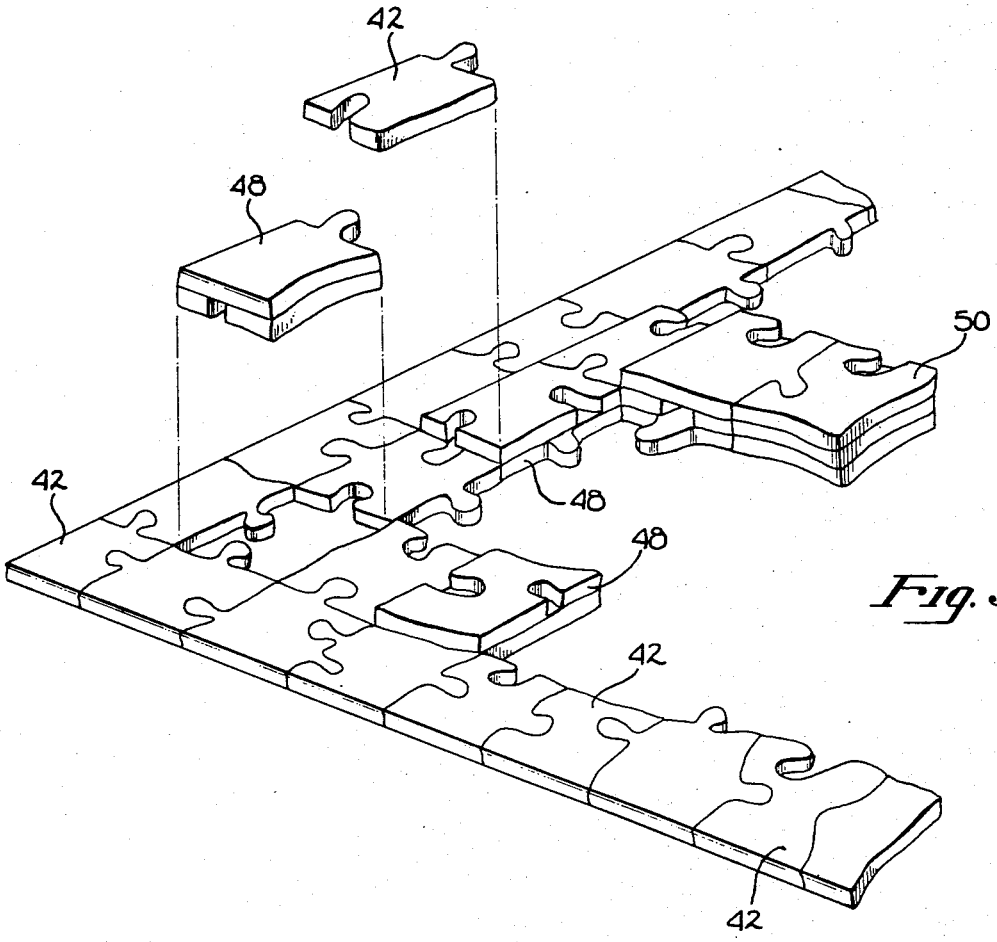
FIG. 5 is a perspective view of a partially assembled puzzle showing the interrelationship of single-layered and multi-layered interlocking puzzle pieces.

With reference to FIG. 1, a three dimensional jigsaw puzzle is shown in an assembled state. In the presently preferred embodiment, as shown in FIG. 1, the puzzle is comprised of three different planar layers or levels, generally identified as bottom level 10, intermediate level 20, and top level 30. The top level 30 of the puzzle is smaller in surface area than, and is substantially concentric with, the intermediate level 20 of the puzzle. Similarly, the bottom level 10 of the puzzle has a larger surface area than, and is substantially concentric with, the intermediate level 20 of the puzzle, such that a pictorial illustration can be seen on the exposed surface of each level of the puzzle.

In the preferred embodiment, when the puzzle is properly assembled, a homogeneous and continuous pictorial illustration is shown across the entire visible surface of the puzzle. If desired, the surfaces of the various levels of the puzzle or the individual puzzle pieces may be of different colors or pictorial illustrations in order to produce blends or contrasts between visible portions of adjacent levels.

In FIG. 1, the three levels of the puzzle are shown in the shape of a rectangle. However, it will be understood that the configuration of each level of the puzzle may be varied to obtain the particular aesthetic effect desired. Futhermore, each level may be of the same or different surface area, and the levels need not be in a concentric relationship with each other.

The side shapes or edges 40 coinciding with the periphery of each level of the puzzle are shown to be substantially straight with respect to the surfaces of the levels of the puzzle. The side shapes 40 do not display a pictorial illustration in the preferred embodiment. Nevertheless, the side shapes 40 may display a pictorial illustration and be of a contoured, beveled, sloped or other shape, depending upon the aesthetic effect to be achieved.

Referring now to FIGS. 2–4, the individual interlocking puzzle pieces which comprise the puzzle are shown. The puzzle pieces may be constructed from wood, compressed fiber, plastic, metal or other suitable materials that will not easily become delaminated, wear out, or allow the pictorial illustration to be worn off the surface of the puzzle pieces.

A portion of a pictorial illustration appears on the surface of each interlocking puzzle piece. When the puzzle is properly assembled, the combination of pictorial illustrations appearing on the surface of each interlocking piece forms a continuous, homogeneous pictorial illustration which covers the entire surface of each visible level of the puzzle.

The single-layered puzzle piece 42 of FIG. 2 has a substantially flat bottom and surface. In addition, each single-layered piece 42 is of substantially the same thickness as other single-layered puzzle pieces. In order for a single-layered puzzle piece 42 to be matched and interlocked with the proper puzzle piece on the proper level, a number of notches 44 and protrusions 46 are provided.

The multi-layered puzzle pieces 48 and 50 of FIGS. 3 and 4 are comprised of single-layered puzzle pieces 42 that have been joined to each other at corresponding points on adjacent levels of the puzzle. Multi-layered puzzle piece 48 of FIG. 3 is in the present embodiment comprised of two single-layered puzzle pieces, and multi-layered puzzle piece 50 of FIG. 4 is comprised of three single-layered puzzle pieces. Joining the single-layered puzzle pieces 42 to form the multi-layered puzzle pieces 48 and 50 may be accomplished by means of gluing, cementing or other suitable adhesive means. Notches 44 and protrusions 46 are provided on each single-layered puzzle piece 42 that comprises the multi-layered puzzle pieces 48 and 50. The notches 44 and protrusions 46 on each level of the multi-layered puzzle pieces 48 and 50 match the notches and protrusions of adjacent puzzle pieces on corresponding levels of the puzzle. It will be appreciated, that although multi-layered puzzle pieces 48 and 50 are shown as a combination of joined single-layered pieces, that the multi-layered pieces may also be formed as a single unitary piece having appropriate protrusions and notches.

Thus, when the puzzle is being assembled, single-layered puzzle pieces 42 will fit on any of the three levels of the puzzle. Multi-layered puzzle pieces 48 may fit on and comprise all or a portion of, the bottom 10 intermediate 20 and top 30 levels of the puzzle. Multi-layered puzzle piece 50 will fit only all three levels of the puzzle and may not be stacked on top of any other puzzle pieces.

Referring now to FIG. 5, the corner end of a partially completed puzzle is shown. While assembly of the puzzle may be initiated from the corner of the puzzle, as shown in FIG. 5, it will be understood that the solution to the puzzle does not depend upon which section of the puzzle the assembler chooses to start. With this in mind, one method of solving the puzzle of the preferred embodiment will now be explained.

Figure 6:
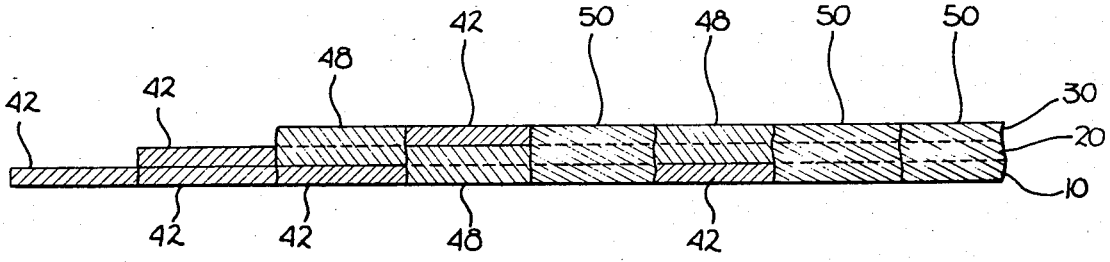
FIG. 6 is a side elevational view of one end of the puzzle showing a cross-section of the assembled puzzle and the interrelationship of the single layered and multi-layered interlocking puzzle pieces.

The puzzle of the preferred embodiment is assembled on three levels and is comprised of the three different types of puzzle pieces shown in FIGS. 2–4, namely single-layered puzzle pieces 42 and multi-layered puzzle pieces 48 and 50. Each level of the puzzle may be assembled by using any combination of the single-layered and multi-layered puzzle pieces 42, 48 and/or 50. Construction of the puzzle may be started with any one of the three types of puzzle pieces. However, a puzzle piece may not be matched with a puzzle piece on a higher level 20 or 30 of the puzzle until the spaces underneath the piece to be matched have been filled with puzzle pieces on lower levels 10 and 20 of the puzzle. For example, if the assembler were to start assembling the puzzle with a three layered puzzle piece 50, the next puzzle piece he chooses to match the first piece with must at least fill the first layer 10 of the puzzle. Thus, the puzzle assembler could not match a single-layered piece 42 to the third level 30 of a three layered puzzle piece 50 until the levels 10 and 20 beneath the single-layered piece 42 have been filled. Reference to FIG. 6 further clarifies the foregoing example by illustrating the interrelationship between the three different types of puzzle pieces. It can be seen that omission of any one of the single-layered puzzle pieces 42 from the first level 10 of the puzzle would create voids in the first level 10 of the puzzle, and accordingly, would not constitute a properly completed puzzle.

Thus, those portions of the first level 10 which are to be covered by the second level 20 must be fully completed before the second level 20 can be fully completed, and those portions of the second level 20 which are to be covered by the third level 30 must be fully completed before the third level 30 can be fully completed. This does not preclude construction of all three levels of the puzzle simultaneously; it only precludes completion of higher levels of the puzzle until the appropiate lower levels of the puzzle have been completed.

The degree of complexity in assembling the puzzle of the preferred embodiment should satisfy even the most experienced puzzle assembler. The number and type of puzzle pieces may be varied in order to increase or decrease the degree of complexity of assembling the puzzle. Generally, increasing the number and types of puzzle pieces will increase the degree of complexity of assembly. Thus, if the puzzle is comprised of five levels, the puzzle pieces may be one, two, three, four or five layers thick, and the degree of complexity accordingly increased. Reducing the number of levels and number of puzzle pieces will reduce the degree of complexity of assembling the puzzle.

Thus, an improved three dimensional puzzle has been disclosed. While the invention has been particularly described with reference to the embodiment illustrated in FIGS. 1–6, it is contemplated that many modifications in material, construction and configuration could be made by one of ordinary skill in the art without departing from the spirit and scope of the invention.

I claim:

1. A self-supporting, three dimensional jigsaw puzzle, comprising:

a plurality of first puzzle pieces having a first layer thickness;

a plurality of second puzzle pieces having a two layer thickness substantially twice the thickness of said first layer thickness;

a plurality of third puzzle pieces having a three layer thickness substantially three times the thickness of said first puzzle pieces;

said puzzle pieces being shaped to have interlocking portions, such that each of said pieces interlocks with at least one selected other of said pieces;

said second and third pieces each having separate and distinct ones of said interlocking portions disposed at two and three vertically disposed planar layers, respectively, such that said second and third pieces interlock with adjacent pieces at two and three layers of the puzzle, respectively, thereby rigidly coupling the adjacent layers and supporting the entire puzzle;

said first, second and third pieces being coupled to one another in a predetermined combination in order to provide a plurality of planar and concentric layers having differing surface areas;

whereby a self-supporting three dimensional puzzle having multiple layers is provided by combining and interlocking said single and multi-layered pieces in a predetermined configuration.

2. The puzzle as defined by claim 1, wherein said plurality of planar layers displays a continuous and homogeneous pictorial illustration when said puzzle is properly assembled.

3. The puzzle as defined by claim 2, wherein the bottom-most planar layer is of the greatest surface area, and each succeeding planar layer is concentrically superimposed upon said bottom-most layer and is of increasingly smaller surface area.

* * * * *